US010603899B1

(12) United States Patent
Cho

(10) Patent No.: US 10,603,899 B1
(45) Date of Patent: Mar. 31, 2020

(54) INKJET PRINTING METHOD AND APPARATUS

(71) Applicant: STI CO., LTD., Anseong-si, Gyeonggi-do (KR)

(72) Inventor: Yuhho Cho, Anseong-si (KR)

(73) Assignee: STI CO., LTD., Anseong-si (KR)

( * ) Notice: Subject to any disclaimer, the term of this patent is extended or adjusted under 35 U.S.C. 154(b) by 0 days.

(21) Appl. No.: 16/227,905

(22) Filed: Dec. 20, 2018

(30) Foreign Application Priority Data

Sep. 6, 2018 (KR) ..... 10-2018-0106672

(51) Int. Cl.
*B41J 2/045* (2006.01)
*B41J 2/21* (2006.01)
*B41M 3/00* (2006.01)

(52) U.S. Cl.
CPC ..... *B41J 2/04508* (2013.01); *B41J 2/04586* (2013.01); *B41J 2/2132* (2013.01); *B41M 3/003* (2013.01)

(58) Field of Classification Search
CPC ..... B41J 2/2056; B41J 2/2054; B41J 2/2132; B41J 29/393; B41J 2/135; B41J 2/362; B41J 2/04508; B41J 2/04586; B41J 2/2142; B41M 3/003
See application file for complete search history.

(56) References Cited

U.S. PATENT DOCUMENTS 8,403,445 B2 * 3/2013 Iwasaki ..... B41J 2/205 347/14

FOREIGN PATENT DOCUMENTS

JP 2017-064920 A 4/2017

* cited by examiner

*Primary Examiner* — Thinh H Nguyen
(74) *Attorney, Agent, or Firm* — Novick, Kim & Lee, PLLC; Sang Ho Lee

(57) ABSTRACT

Provided is an inkjet printing method using a plurality of nozzles which are controlled to discharge discrete quantities of ink mapped to a specific control value, of which a control value and discrete quantities of ink are mapped, if the specific control value is inputted, the inkjet printing method including the steps of: inputting a control value mapped to specific discrete quantities of ink to the plurality of nozzles to measure discharge performance of the plurality of nozzles; classifying the plurality of nozzles into a plurality of nozzle groups based on the discharge performance measured on the plurality of nozzles; adjusting a mapped relation between the discrete quantities of ink and the control value for the classified nozzle groups; and performing inkjet printing based on a mapped relation between the discrete quantities of ink and the control value.

10 Claims, 7 Drawing Sheets

INKJET PRINTING METHOD AND APPARATUS

CROSS-REFERENCE TO RELATED APPLICATIONS

The instant application claims priority to Korean patent application No. 10-2018-0106672 filed on Sep. 6, 2018, the entire disclosure of which is hereby incorporated by reference.

BACKGROUND OF THE INVENTION

Field of the Invention

The present disclosure relates to an inkjet printing method and apparatus.

Background of the Related Art

When a layer of a fine thickness is formed by use of an inkjet technology, to uniformly maintain the fine thickness is one of important manufacturing technologies. Due to deviations in performance of nozzles for printing the layer, interference in adjacent nozzles, physical properties of ink, and so forth, it can hardly form a layer of a fine thickness while achieving the wanted uniformity. In particular, since a difference between discharge characteristics of the nozzles becomes a big problem, various methods have been proposed to compensate the difference.

SUMMARY OF THE INVENTION

According to the present disclosure, a nozzle for discharging discrete quantities of ink according to a control value is inputted by a different control value to discharge the same quantities of the ink, depending upon the discharge performance of the respective nozzles. Therefore, the present disclosure provides an inkjet printing method and apparatus that can ensure the uniformity of a layer formed by the ink discharged from a plurality of nozzles.

In order to minimize deviations in discharge performance of the nozzles, according to the present disclosure, a plurality of nozzles to eject the discrete quantities of ink corresponding to various control values, thereby forming a printed layer. Even in case where a plurality of nozzles are inputted by various control values to discharge discrete quantities of ink corresponding to the control values, the present disclosure provides an inkjet printing method and apparatus that can form a printed layer of a uniform thickness by controlling the sum of quantities of the ink actually discharged from the nozzles for a print region to be equal to the sum of quantities of ink in case where the respective nozzles discharges wanted quantities of the ink.

According to one aspect of the present disclosure, there is provided an inkjet printing method using a plurality of nozzles which are controlled to discharge discrete quantities of ink mapped to a specific control value, of which a control value and discrete quantities of ink are mapped, if the specific control value is inputted, the inkjet printing method including the steps of: inputting a control value mapped to specific discrete quantities of ink to the plurality of nozzles to measure discharge performance of the plurality of nozzles; classifying the plurality of nozzles into a plurality of nozzle groups based on the discharge performance measured on the plurality of nozzles; adjusting a mapped relation between the discrete quantities of ink and the control value for the classified nozzle groups; and performing inkjet printing based on a mapped relation between the discrete quantities of ink and the control value.

According to one embodiment, the step of classifying the plurality of nozzles into the plurality of nozzle groups includes a step of sorting the plurality of nozzle groups to correspond to the number of steps of the control value for controlling the plurality of nozzles.

According to one embodiment, the step of classifying the plurality of nozzles into the plurality of nozzle groups includes a step of classifying the plurality of nozzle into the plurality of nozzle groups based on a dispersion of the discharge performance determined on the plurality of nozzles.

According to one embodiment, if the print region is printed by discharging the plurality of droplets, the step of performing inkjet printing based on the mapped relation between the adjusted discrete quantities of ink and the control value includes a step of randomly selecting a combination of the discrete quantities of ink so that the discrete quantities of ink to be uniformly discharged for the print region are equal to an average of the discrete quantities of ink droplets.

According to another aspect of the present disclosure, there is provided an inkjet printing apparatus having a plurality of nozzles which are controlled to discharge discrete quantities of ink mapped to a specific control value, of which a control value and discrete quantities of ink are mapped, if the specific control value is inputted, the inkjet printing apparatus including: a nozzle performance measuring circuit for measuring discharge performance of the plurality of nozzles by inputting a control value mapped to specific discrete quantities of ink to the plurality of nozzles; a nozzle classifying circuit for classifying the plurality of nozzles into a plurality of nozzle groups based on the discharge performance measured on the plurality of nozzles; a nozzle control adjusting circuit for adjusting a mapping relation between the discrete quantities of ink and the control value for the classified nozzle groups; and a printing circuit for performing inkjet printing based on a mapped relation between the discrete quantities of ink and the control value.

According one embodiment, if the print region is printed by discharging the plurality of droplets, the printing circuit randomly selects a combination of the discrete quantities of ink so that the discrete quantities of ink to be uniformly discharged for the print region are equal to an average of the discrete quantities of ink droplets.

The present disclosure provides a physical recording medium recorded with a program capable of executing the above method.

Also, the present disclosure provides the program recorded on the physical recording medium realized to execute the above method.

With the above configuration of the inkjet printing method and apparatus according to the present disclosure, the nozzle for discharging the discrete quantities of ink according to the control value is inputted by the different control value to discharge the same quantities of the ink, depending upon the discharge performance of the respective nozzles, thereby ensuring the uniformity of the printed layer.

In order to minimize deviations caused by the discharge performance of the nozzles, the present disclosure enables a plurality of nozzles to eject the discrete quantities of ink corresponding to various control values, thereby forming the printed layer. In this instance, the inkjet printing method and apparatus that can form the printed layer of a uniform thickness by controlling an average value of the quantities of the ink actually discharged from the nozzles for one print region not to be deviated from the quantities of ink.

DETAILED DESCRIPTION OF THE PREFERRED EMBODIMENT

Figure 1:
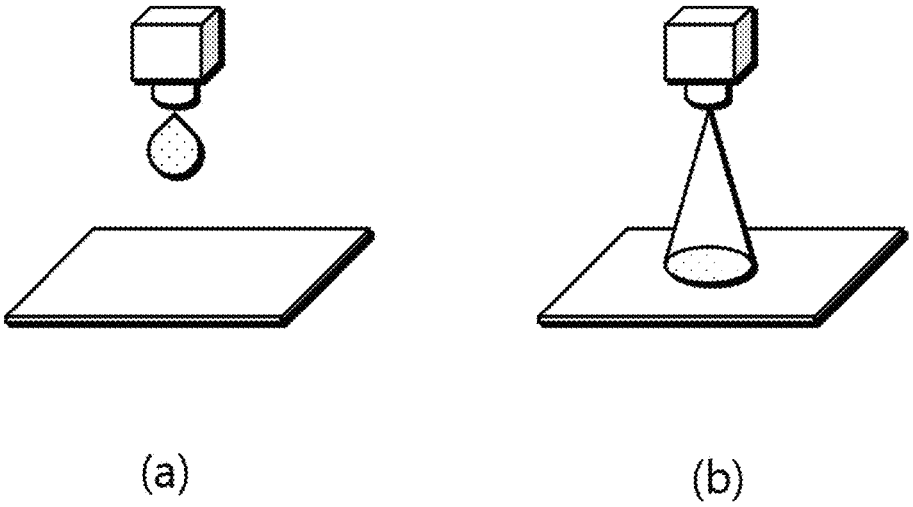
FIG. 1 is a view illustrating an ink droplet to be discharged from a nozzle when an inkjet printing method according to one embodiment of the present disclosure is applied.

Hereinafter, embodiments of the present disclosure will be explained in detail with reference to the accompanying drawings so that those skilled in the art can easily carry out the present disclosure. In the following description, detailed descriptions of well-known functions or constructions will be omitted since they would obscure the invention in unnecessary detail. The same or equivalent components, members and processes shown in Figures are given by the identical reference numerals and the repeated description thereof will be omitted as appropriate.

FIG. 1 is a view illustrating an ink droplet to be discharged from a nozzle when an inkjet printing method according to one embodiment of the present disclosure is applied. FIG. 1A is a view illustrating the ink droplet before the ink is discharged from a nozzle, but is not deposited on the printing surface, and FIG. 1B is a view illustrating the state in which the ink droplet discharged from the nozzle is deposited on the printing surface.

The inkjet printing method and apparatus according to the present disclosure can perform inkjet printing by use of a plurality of nozzles. The plurality of nozzles can be controlled in such a way that discrete quantities of ink are respectively mapped to a control value, and if the nozzles are inputted by a specific control value, the discrete quantities of ink mapped to the control value are discharged. In other words, the plurality of nozzles can discharge quantities of ink having a separate value according to the input of the control value, wherein the control value and the discrete quantities of ink mapped to the control value can be varied depending upon setting of a user. It will be understood that the control value has the separate value. However, an electric current or voltage which is continuously changed can be used to represent the control value having the separate value.

Herein, it will be described that each nozzle is controlled so that the control value is differently mapped to the quantities of ink to be discharged. Hereinafter, it will be described the inkjet printing method and apparatus that can control the plurality of nozzles by managing the control value and the discrete quantities of ink to be discharged, so that the nozzles can discharge the discrete quantities of ink uniformly, in spite of deviations in discharge performance of the nozzles.

A nozzle that is controlled to discharge discrete quantities of ink according to a control value is referred to as a grayscale nozzle, and the control value inputted to the nozzle is referred to as a grayscale value. The nozzle can discharge the discrete quantities of ink stepwise varied according to the grayscale value. Herein, a quantity of ink set to be discharged from the nozzle through one ejection operation will be described as a discrete quantity of ink.

If each nozzle is inputted by a control value mapped to the same discrete quantity of ink, it is expected that the same quantity of ink is discharged from the nozzle. However, a different quantity of ink can be discharged according to the discharge performance of the respective nozzles.

For example, even though the nozzles are inputted by a control value to discharge the ink of 5.00 pl, the respective nozzles can discharge the ink of different quantities, for example, from 4.96 pl to 5.05 pl. A thickness of the printed layer printed by the plurality of nozzles will not be uniform according to variations in quantities of the ink actually discharged. Accordingly, the present disclosure adjusts the discrete quantity of ink mapped to the control value for each nozzle by measuring the discharge performance of the plurality of nozzles before inkjet printing, and inputs the adjusted control value to the respective nozzles to print a layer of desired thickness.

In order to measure the discharge performance of the nozzle, as illustrated in FIG. 1A, it is possible to take a picture of a shape of ink droplet before the ink discharged from the nozzle is deposited on the printing surface, and to calculate a volume of the ink droplet based on a radius and length of the ink droplet. Also, as illustrated in FIG. 1B, it is possible to calculate the volume of the discharged ink by figuring out a radius, width and height of the ink deposited on the printing surface, or properties of the discharged ink, in consideration of diffusion of the ink after the ink droplet discharged from the nozzle is deposited on the printing surface. Of course, according to embodiments, it is possible to determine the droplet discharge performance of the nozzle by use of at least any one of two methods, or determine the droplet discharge performance of the nozzle by use of other method.

Figure 2:
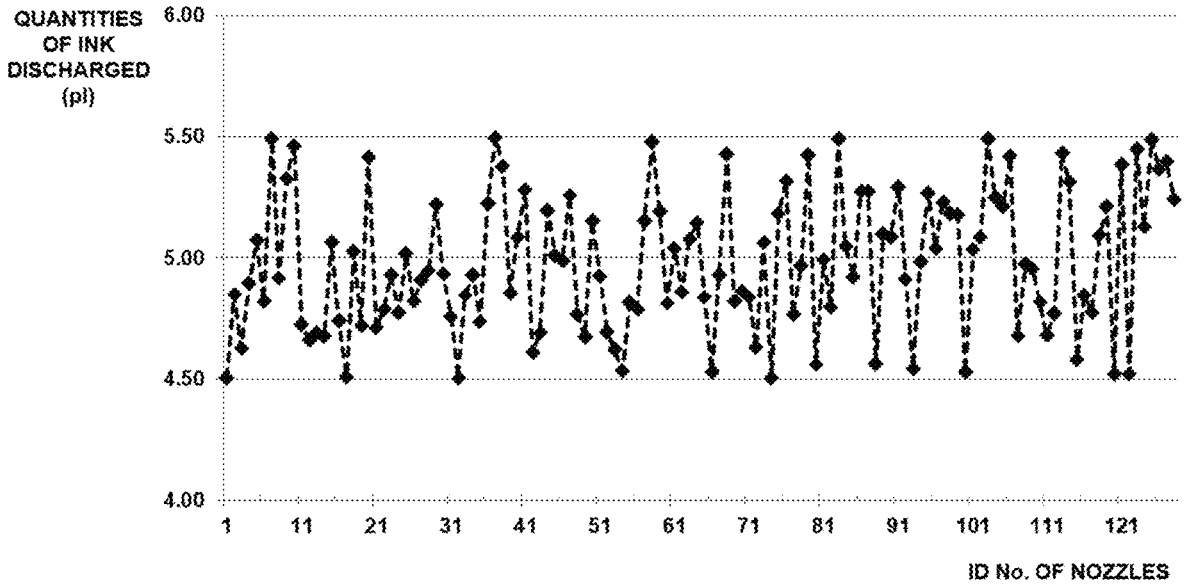
FIG. 2 is a graph showing discharge performance of a plurality of nozzles according to one embodiment of the present disclosure.

FIG. 2 is a graph showing the result of observing the discharge performance of the plurality of nozzles according to one embodiment of the present disclosure.

FIG. 2 shows the observation of the quantities of the ink discharged in case where each nozzle is inputted by a control value to discharge the discrete quantities of 5.00 pl ink.

As described above, if the nozzles for use in the inkjet printing method according to the present disclosure are inputted by specific control values, the nozzles are controlled to discharge the discrete quantities of ink mapped to the control values. In case where discrete quantities of ink mapped to the control values for all nozzles are equal to each other, if all nozzles discharge the same quantities of ink, all nozzles can be inputted by the same control value. Alternatively, in case where the discharge performance of the nozzles has been already measured and different control value is mapped to each nozzle for the same discrete quantities of ink, each nozzle may be inputted by a control value mapped to the nozzle, thereby discharging the same discrete quantities of ink.

It will be understood from FIG. 2 that quantities of ink actually discharged from each nozzle are diversely distributed on the basis of 5.00 pl. Since the discharge performance of each nozzle is different, the ink of different quantities is discharged even though a control value is inputted to discharge the same discrete quantities of ink.

In case where the nozzles are expected to discharge the ink of the same quantities, but discharge the ink of different quantities, it is possible to adjust mapping setting in which a discrete quantity of ink is mapped to a control value for each nozzle to improve the uniformity of the printed layer.

Figure 3:
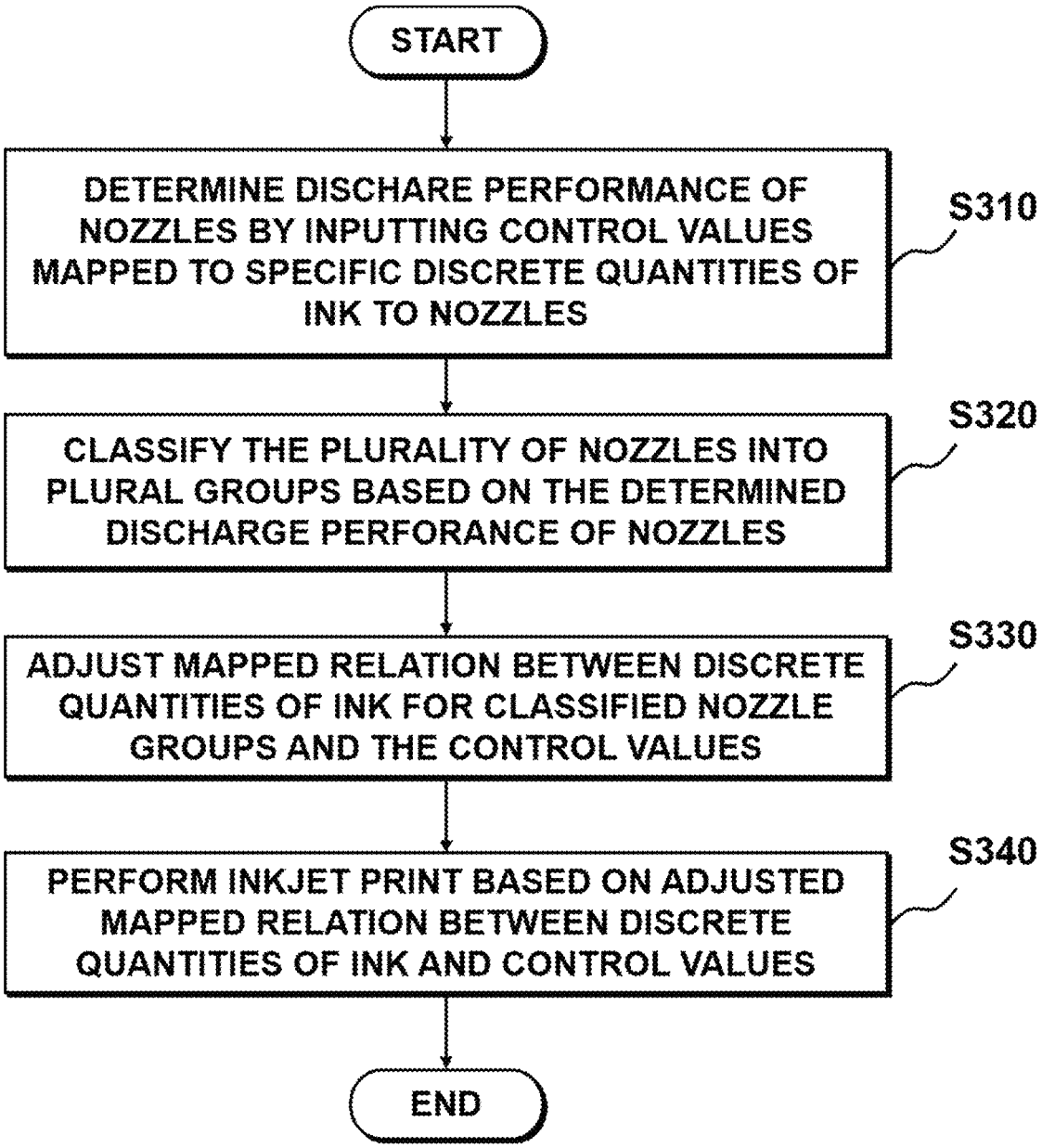
FIG. 3 is a flowchart illustrating an inkjet printing method according to one embodiment of the present disclosure.

FIG. 3 is a flowchart illustrating the inkjet printing method according to one embodiment of the present disclosure.

According to the present disclosure, referring to FIG. 3, a plurality of nozzles is inputted by control values mapped to which specific discrete quantities of ink to measure discharge performance of the plurality of nozzles according to a command of discharging the ink (step S310). According to one embodiment, it is possible to measure the discharge performance of the nozzles based on a property of the dispersed quantity of the ink discharged from the nozzle.

At step S310, as described with reference to FIG. 1, the ink discharged from each nozzle is observed, and then the quantity of ink is calculated, according to the result of the ink discharged from a plurality of nozzles. It will be understood from FIG. 2 that the quantities of the ink discharged from the nozzle are regarded as the discharge performance of the nozzles. However, it is possible to measure and predict the quantities of ink discharged from the nozzles by various methods.

For example, it is possible to determine the discharge performance of the nozzle of interest by calculating the average discrete quantity of ink which is measured by making a kind and/or property of ink supplied to the nozzle or allowing the nozzle to perform discharge operation several times.

Based on the determined discharge performance, it is possible to classify the plurality of nozzles into plural groups (step S320). The process of classifying the plurality of nozzles into plural groups may be performed by various ways.

In case where the plurality of nozzles has various discharge performance from 4.50 pl to 5.50 pl, as illustrated in FIG. 2, the plurality of nozzles may be classified by dividing nozzle distribution into plural sections according to the measurement result. Alternatively, the plurality of nozzles can be classified according to the number of control levels (e.g., the number of grayscale levels) at which each nozzle is controlled.

The number of control levels to control the nozzles can correspond to the number of steps of detecting a control value of each nozzle and controlling the discrete quantity of ink. By classifying the number of nozzles into nozzle groups to correspond to the number of control levels which can sort the nozzles, it is possible to differently adjust the control values mapped to the same discrete amount of ink for each nozzle group.

Specifically, the step of classifying the plurality of nozzles into plural nozzle groups can include a step of selecting the whole classified groups from the nozzles to be classified, and a step of determining a standard of classifying the nozzles contained in the selected group to classify the nozzles into the nozzle groups.

In case where the measured discharge performance of all nozzles is distributed within a constant range, as illustrated in FIG. 2, all nozzles can be included in the classified group. However, in case where some nozzles have big deviations in measured discharge performance, the nozzles having big deviations may be eliminated from the classified group.

Table 1 shows that the ranges of the quantities of discharged ink measured from the nozzles are evenly divided and are given by indexes of discharge performance.

TABLE 1

| Index of discharge performance | Quantities of ink actually discharged (pl) | Discrete quantities of ink (pl) |
|---|---|---|
| −7 | 4.50-4.54 | 4.50 |
| −6 | 4.55-4.61 | 4.57 |
| −5 | 4.62-4.68 | 4.64 |
| −4 | 4.69-4.75 | 4.71 |
| −3 | 4.76-4.82 | 4.79 |
| −2 | 4.83-4.89 | 4.86 |
| −1 | 4.90-4.96 | 4.93 |
| 0 | 4.97-5.03 | 5.00 |
| 1 | 5.04-5.10 | 5.07 |
| 2 | 5.11-5.17 | 5.14 |
| 3 | 5.18-5.24 | 5.21 |
| 4 | 5.25-5.31 | 5.29 |
| 5 | 5.32-5.38 | 5.36 |
| 6 | 5.39-5.45 | 5.43 |
| 7 | 5.46-5.50 | 5.50 |

For example, if the plurality of nozzles is inputted by a control value "0" at an initial step from a factory, the nozzles can be mapped to discharge precise discrete quantities of ink, i.e., 5.00 pl. It will be observed that even though a control value "0" is inputted, the ink of quantities dispersed within the range of 4.50 pl to 5.50 pl is discharged from the nozzle (e.g., as illustrated in FIG. 2). Of course, as described above, after the control value and the mapped value of the discrete quantities of ink discharged by the control value are adjusted, instead of the control value set at the initial factory step, even in case where the control value is inputted to expect the same discrete quantities of ink to be discharged from the nozzles, the same result can be obtained, as illustrated in FIG. 2.

The indexes of the discharge performance of each nozzle can be classified, as shown in Table 1. The index of the discharge performance can be given to the nozzle, based on the difference between the wanted discrete quantities of ink to be discharged from the nozzle, 5.00 pl, and the quantities of ink actually discharged from the nozzle. The nozzles corresponding to the index of the discharge performance can be given by the discrete quantities of discharged ink which is mapped to the control value. The discrete quantities of ink mapped to the input control value can correspond to a middle value within the range of the quantities of ink actually discharged.

Specifically, the first nozzle group may include nozzles to discharge the ink of more than 4.50 pl and less than 4.54 pl, in response to the input of the control value which is expected to discharge the quantities of ink, 5.00 pl, corresponding to an index '-7' of the discharge performance. Alternatively, a boundary value of the quantities of ink actually discharged which is given by the index of discharge performance may be determined by other methods.

Since the nozzles included in the first nozzle group have the lowest discharge performance relative to the normal nozzles, 5.00 pl discrete quantities of ink are mapped to a control value '+7'. That is, it is expected that the first nozzle group should be inputted by the largest control value which can be recognized by the nozzle, so that the ink of 5.00 pl can be discharged.

The second nozzle group includes nozzles capable of discharging the ink of more than 4.55 pl and less than 4.61 pl. The nozzles contained in the second nozzle group have the discharge performance higher than that of the first nozzle group, but do not discharge the ink as much as 5.00 pl which is expected. Therefore, in case of the second nozzle group, 5.00 pl discrete quantities of ink are mapped to a control value '+6'.

The third nozzle group contains nozzles capable of discharging the ink of more than 4.62 pl and less than 4.68 pl. In case of the third nozzle group, 5.00 pl discrete quantities of ink are mapped to a control value '+5'. The results can be obtained by mapping the discrete quantities of ink to the respective nozzle groups, as shown in Table 2.

TABLE 2

| Nozzle groups | Quantity distribution of ink actually discharged | Control value mapped to 5.00 pl |
|---|---|---|
| #1 | 4.50-4.54 | 7 |
| #2 | 4.55-4.61 | 6 |
| #3 | 4.62-4.68 | 5 |
| #4 | 4.69-4.75 | 4 |
| #5 | 4.76-4.82 | 3 |
| #6 | 4.83-4.89 | 2 |
| #7 | 4.90-4.96 | 1 |
| #8 | 4.97-5.03 | 0 |
| #9 | 5.04-5.10 | −1 |
| #10 | 5.11-5.17 | −2 |
| #11 | 5.18-5.24 | −3 |
| #12 | 5.25-5.31 | −4 |
| #13 | 5.32-5.38 | −5 |
| #14 | 5.39-5.45 | −6 |
| #15 | 5.46-5.50 | −7 |

According to one embodiment, the nozzle groups are not classified by evenly dividing the quantities of ink actually discharged from the nozzles, as shown in Table 1, but the group may be formed by classifying plural nozzle groups based on a standard deviation in the quantities of ink actually discharged, or considering the number of nozzles included in the respective nozzle groups, so that the same number of nozzles is included in each nozzle group.

The discrete quantities of ink for the classified nozzle groups and the control values mapped to the discrete quantities of ink are adjusted (step S330). That is, mapped relation between discrete quantities of ink for classified nozzle groups and the control values is adjusted. For example, the control value for the respective nozzle groups can be adjusted, as shown in Table 2. In case of forming a layer by ejecting the ink of 5.00 pl according to the adjustment of the control value, the respective nozzle groups may be inputted by a different control value.

According to one embodiment, the control value mapped to which 5.00 pl discrete quantities of ink (see Table 2) for each nozzle group may be in inverse proportion to the index of the discharge performance determined to the classified nozzle group (see Table 1). Accordingly, the discrete quantities of ink for the classified nozzle groups and the control value mapped to the discrete quantities of ink may be determined based on the difference between the wanted discrete quantities of ink to be discharged and the quantities of ink actually discharged from the nozzle. As a result, in case where the index of discharge performance for the nozzle, to which the same discrete quantities of ink are applied, is low, the control value may be adjusted to high. In case where the index of discharge performance is high, the control value may be adjusted to low.

According to one embodiment, the control value may be determined according to a time required for maintaining a voltage inputted to the nozzle by a predetermined value. For example, as the control value is increased, the time required for maintaining the control voltage inputted to the nozzle by a predetermined value may be increased.

Figure 4:
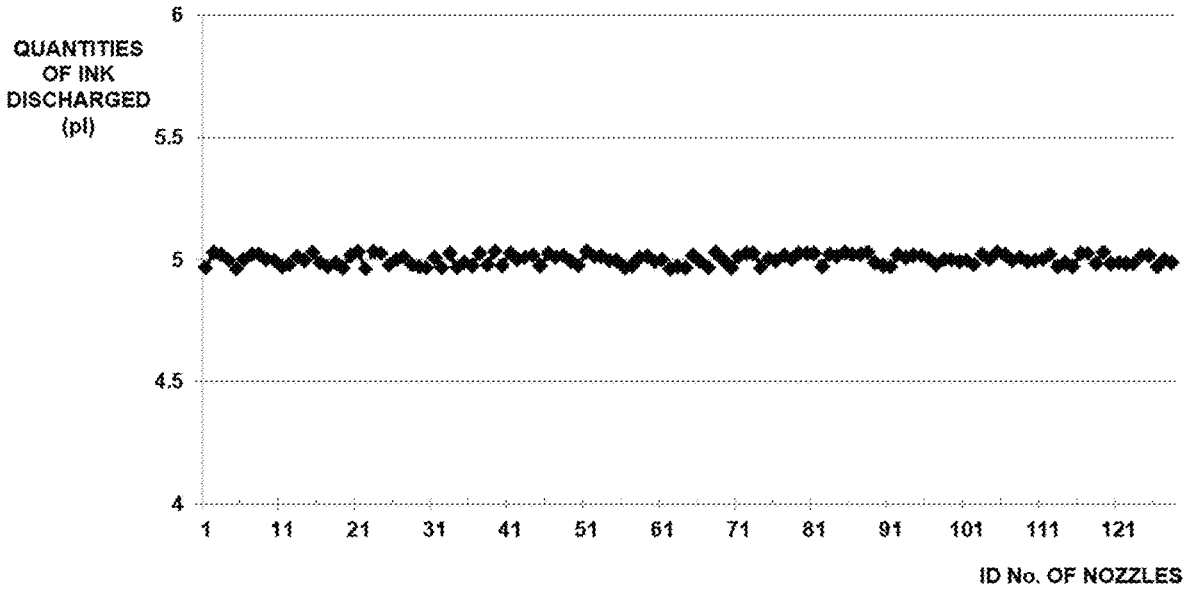
FIG. 4 is a graph showing the results of the measured quantities of discharged ink, of which discrete quantities of ink and control values are adjusted, and the control values mapped to specific discrete quantities of ink are inputted, according to the present disclosure.

In case where the control value is adjusted through the above process, as illustrated in FIG. 4, it will be noted that deviation characteristics in quantities of the ink discharged from the nozzles are improved. FIG. 4 is a graph showing the results of the measured quantities of discharged ink, of which the discrete quantities of ink and the control values are adjusted, and the control values mapped to the specific discrete quantities of ink are inputted, according to the present disclosure.

According to the present disclosure, the mapped relation between the discrete quantities of ink and the control values can be adjusted to input different control values, when it is controlled to discharge the same quantities of ink, based on the discharge performance of each nozzle. Through the above process, it is possible to address the non-uniformity of the printing caused by the deviations in discharge performance of the plurality of nozzles.

According one embodiment, the process of adjusting the discrete quantities of ink and the control values mapped to the discrete quantities of ink for the nozzle groups may be continuously performed. For example, the process of adjusting the discrete quantities of ink and the control values mapped to the discrete quantities of ink may be performed every predetermined time interval, or may be performed whenever a case where the non-uniformity of the printing is deviated from a defined value.

Again, referring to FIG. 3, the inkjet printing can be performed based on the adjusted mapped relation between the discrete quantities of ink and the control values (step S340).

When the inkjet printing is performed based on the adjusted mapped relation, the quantities of discharged ink may be still different, since the nozzle contained in one nozzle group does not discharge the exactly same quantities of ink according to the discharge performance, that is, the nozzles contained in the nozzle group classified by the index of discharge performance (see Table 1) do not discharge the exactly same quantities of ink. In particular, if the nozzles perform several discharge operations, deviations in quantities of the ink each time the ink is discharged are accumulated, thereby deteriorating the final deviations in quantities of the ink.

Specifically, as illustrated in FIG. 4, after the control value inputted to the respective nozzles to discharge the quantities of ink around 5.00 pl is adjusted, the ink of 5.00 pl is exactly discharged from the respective nozzles. Therefore, the deviations in quantities of the discharged ink may be accumulated as several ejection operations are performed.

In case of discharging plural droplets for one print region (e.g., one pixel of a display or one display panel), that is, in case of performing plural discharge operations, such deviations are accumulated within the range of quantity dispersion of the ink discharged from the nozzles corresponding to the respective nozzle groups, thereby deteriorating the uniformity of the printing.

Figure 5:
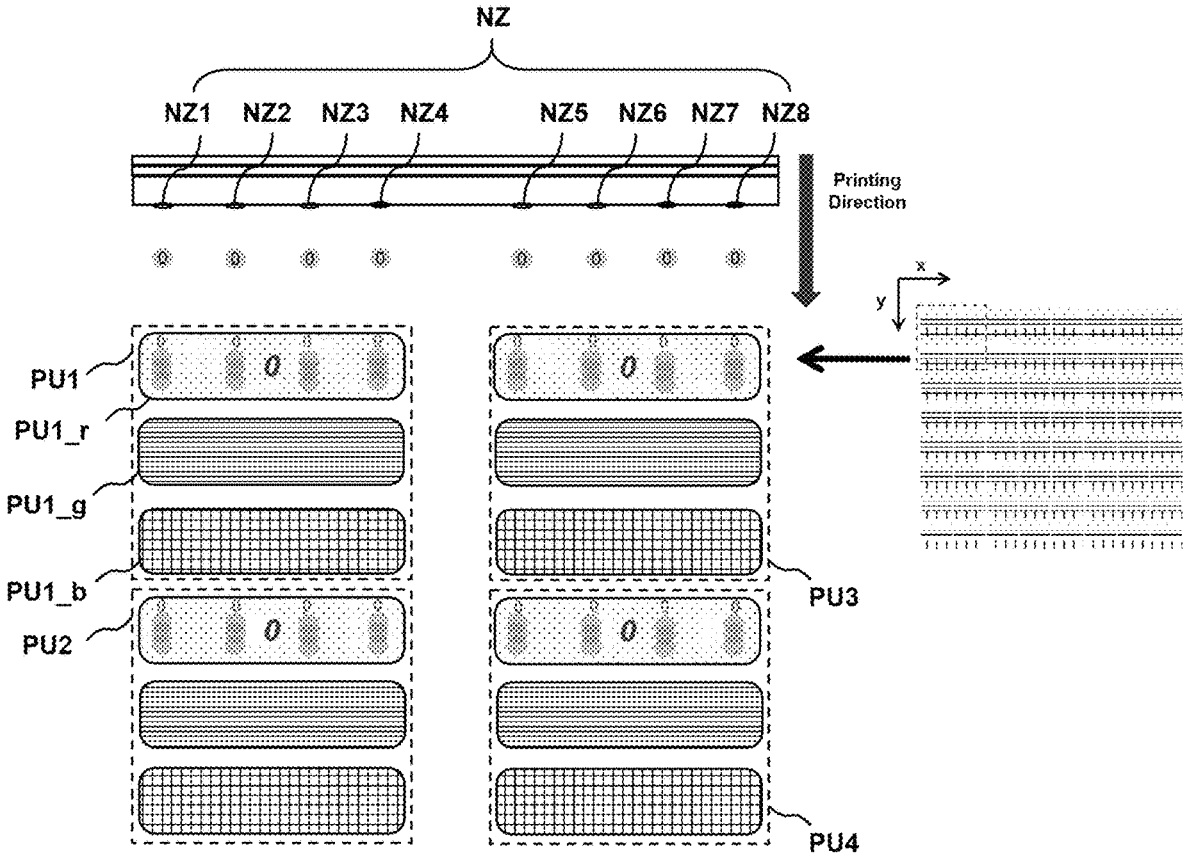
FIG. 5 is a view schematically illustrating a relationship between nozzles and a print region in case of printing a color filter of a display circuit.

FIG. 5 is a view schematically illustrating a relationship between nozzles and a print region in case of printing a color filter of a display circuit.

Referring to FIG. 5, a plurality of auxiliary print regions PU1_*r*, PU1_*g* and PU1_*b* may be contained in one print region PU1, PU2, PU3 or PU4. As illustrated in FIG. 5, one pixel of the display includes a red element, a green element and a blue element, in which these elements can be respectively referred to as a pixel print region or a pixel auxiliary print region. Each print region has a layer formed by the ink as the nozzles perform plural discharge operations. For example, each print region can be printed by four nozzles, and one nozzle NZ can perform plural discharge operations for the print region.

According to the present disclosure, the print region can be printed at least one discharge operation of the plurality of nozzles, or can be printed by plural discharge operations of one nozzle. The print region may be a unit to be set to discharge specific quantities of ink for target discharge. Specifically, the quantities of ink for the target discharge which are set for the print region are quantities set in such a way plural discharge ink for the print region has the discrete quantities of ink for the target discharge, respectively, and thus the print region is uniformly printed as much as the quantities of ink for the target discharge.

The print region can be designated by various modes, for example, the red, blue and green elements forming one pixel in FIG. 5 may be referred to as one print region. One pixel may be referred to as the other print region, plural pixel groups may be referred to as the other print region, or a row or column of pixels forming the display may be referred to as one print region. Of course, the print region is not limited to the display circuit, and can be defined for various products which are printed by the inkjet printing method.

If the print region is controlled by uniformly discharging 5.00 pl discrete quantities of ink from each nozzle, that is, if the wanted discrete quantities of ink for the print region are 5.00 pl, each nozzle can be inputted by a control value mapped to the wanted discrete quantities of ink to perform the printing. In order to uniform the thickness of the printing layer printed through plural discharges of the ink, the quantities of ink discharged from the nozzles are generally controlled not to be deviated from a certain range of the wanted discrete quantities of ink.

The ink of 5.00 pl is not exactly discharged from the respective nozzles according to the control value inputted to the respective nozzles. Therefore, there is a difference between the quantities of ink actually discharged from the nozzles included in the nozzle group and the wanted discrete quantities of ink, and thus the difference is accumulated. As a result, the average value of the sums of the quantities of ink actually discharged from the print region may be deviated from the wanted discrete quantities of ink.

The quantities of ink discharged from the print region are different from each other, and also any pattern may be formed on a print surface due to interference between adjacent nozzles in the process of performing plural discharge operations. Also, if the same control value is repeatedly inputted to the nozzle, the uniform layer is actually formed, but any pattern can be recognized by a user. Therefore, regardless of the quantities of ink actually discharged from the nozzle, it is necessary to control the discharge operation by changing the control value and inputting it to the nozzle, instead of performing the discharge operation by repeatedly inputting the same control value to the nozzle.

With the inkjet printing method according to the present disclosure, when the wanted discrete quantities of ink are determined for the print region, only the control value mapped to the wanted discrete quantities of ink is not inputted, but different control values corresponding to the quantities of ink for the target print, that is, the quantities of ink discharged for the print region by discharging the sum of the discrete quantities of ink mapped to the control value which is equal to the wanted discrete quantities of ink, through plural discharge operations, can be inputted.

Figure 6:
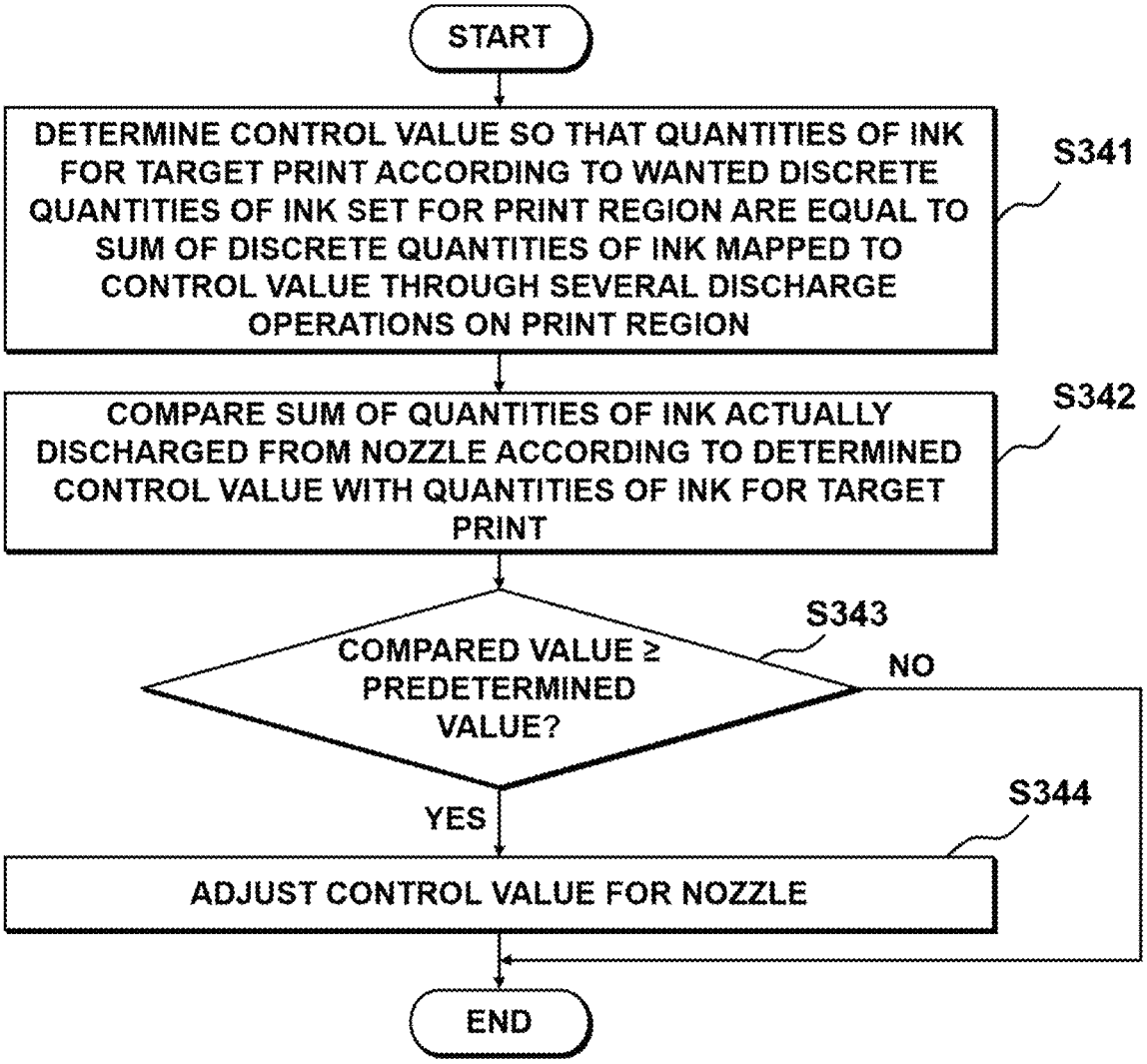
FIG. 6 is a flowchart illustrating a method of determining a control value to be inputted to a nozzle when printing is performed for a print region, in a process of performing inkjet printing based on a mapped relation between discrete quantities of ink and control values which are adjusted by the present disclosure.

FIG. 6 is a flowchart illustrating a method of determining the control value to be inputted to a nozzle when the printing is performed for the print region, in the process of performing the inkjet printing based on the mapped relation between the discrete quantities of ink and the control values which are adjusted by the present disclosure.

Referring to FIG. 6, the control value can be determined so that the average of the discrete quantities of ink mapped to the control value for the respective nozzles through plural discharge operations for the print region corresponds to the discrete quantities of ink for the target discharge which are set for the print region (step S341). In other words, when the discrete quantities of ink mapped to the control values inputted through plural discharge operations are added, the control value can be determined so that the sum is equal to the quantities of ink for the target discharge.

Examples will be described in more detail below.

In case where the discrete quantities of ink and the control values are mapped for the nozzle groups, like Table 2, the discrete quantities of ink and the control values can be mapped for the respective nozzle groups as follows.

Table 3 shows the discrete quantities of ink and the control values mapped thereto for the seventh nozzle group, Table 4 shows the discrete quantities of ink and the control values mapped thereto for the eighth nozzle group, and Table 5 shows the discrete quantities of ink and the control values mapped thereto for the ninth nozzle group.

TABLE 3

| Discrete quantities of ink | Control value |
|---|---|
| 4.43 | −7 |
| 4.50 | −6 |
| 4.57 | −5 |
| 4.64 | −4 |
| 4.71 | −3 |
| 4.79 | −2 |
| 4.86 | −1 |
| 4.93 | 0 |
| 5.00 | 1 |
| 5.07 | 2 |
| 5.14 | 3 |
| 5.21 | 4 |
| 5.29 | 5 |
| 5.36 | 6 |
| 5.43 | 7 |

TABLE 4

| Discrete quantities of ink | Control value |
|---|---|
| 4.50 | −7 |
| 4.57 | −6 |
| 4.64 | −5 |
| 4.71 | −4 |

TABLE 4-continued

| Discrete quantities of ink | Control value |
|---|---|
| 4.79 | −3 |
| 4.86 | −2 |
| 4.93 | −1 |
| 5.00 | 0 |
| 5.07 | 1 |
| 5.14 | 2 |
| 5.21 | 3 |
| 5.29 | 4 |
| 5.36 | 5 |
| 5.43 | 6 |
| 5.50 | 7 |

TABLE 5

| Discrete quantities of ink | Control value |
|---|---|
| 4.57 | −7 |
| 4.64 | −6 |
| 4.71 | −5 |
| 4.79 | −4 |
| 4.86 | −3 |
| 4.93 | −2 |
| 5.00 | −1 |
| 5.07 | 0 |
| 5.14 | 1 |
| 5.21 | 2 |
| 5.29 | 3 |
| 5.36 | 4 |
| 5.43 | 5 |
| 5.50 | 6 |
| 5.57 | 7 |

If there are nozzles corresponding to the seventh to ninth nozzle groups among the nozzles, and the nozzles are set to print only 5.00 pl wanted discrete quantities of ink for the print region, only the control value '1' is not inputted to the seventh nozzle group, only the control value '0' is not inputted to the eighth nozzle group, and only the control value '−1' is not inputted to the ninth nozzle group. The control values are differently changed so that the average discrete quantities of ink for one print region correspond to the wanted discrete quantities of ink, 5.00 pl.

Figure 7:
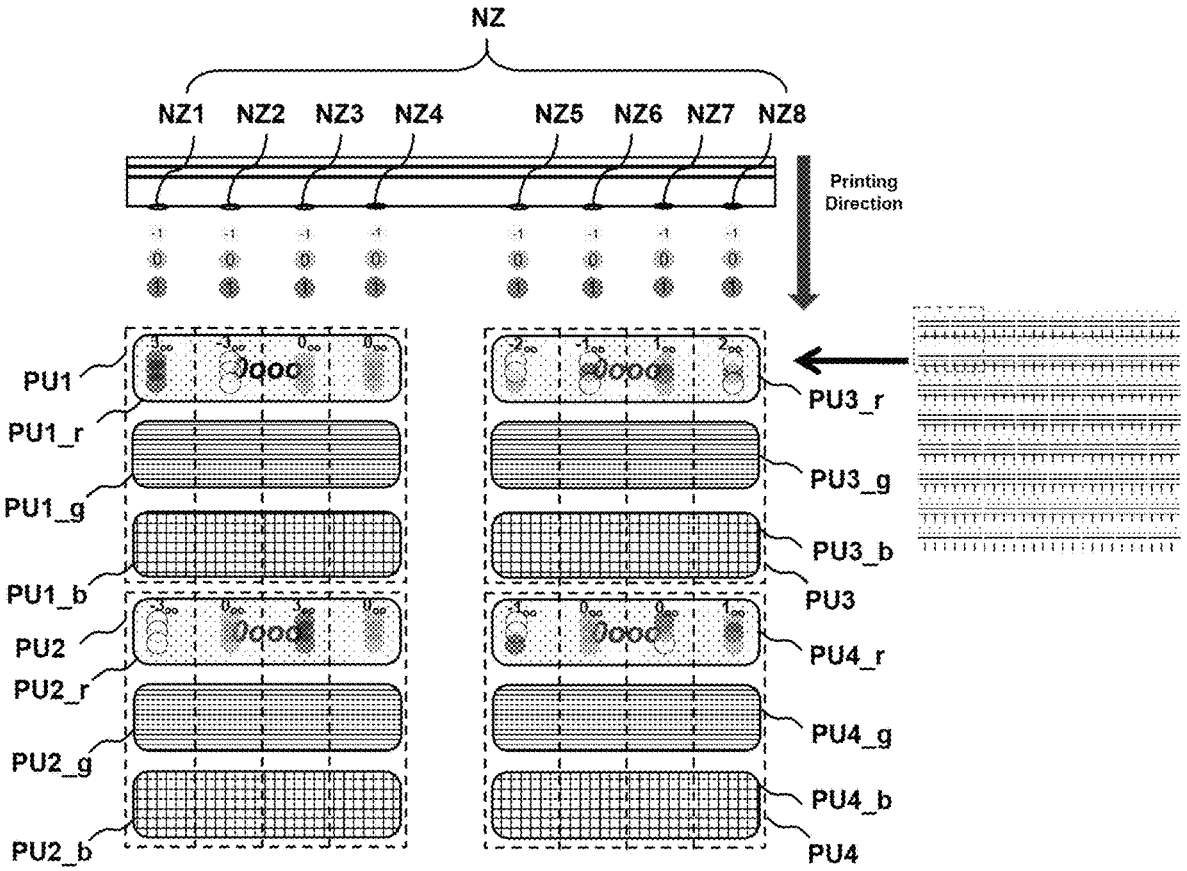
FIG. 7 is a view illustrating a method of inputting different control values to nozzles every ejection operation to manufacture a uniform printed layer.

FIG. 7 is a view illustrating a method of inputting different control values to the nozzles every ejection operation to manufacture the uniform printed layer on which the wanted discrete quantities of ink are uniformly discharged.

In FIG. 7, it will be described on the basis of the state in which each nozzle NZ is inputted by a control value mapped to the discrete quantities of ink at three steps. It will be understood from FIG. 7 that numerals "−1", "0" and "1" of the respective nozzles indicate values corresponding to the discrete quantities of ink. If the discharge performance of all nozzles is equal to each other, the values shown in FIG. 7 may be equal to the control values, and the values shown in FIG. 7 may be equal to the control values for the eighth nozzle group in Table 4. As described above, according to the present disclosure, since a different control value is mapped to the discrete quantities of ink according to the discharge performance of the nozzle, a different control value may be inputted in case where the discrete quantities of ink corresponding to "−1" are discharged from the respective nozzles. More specifically, in case of the seventh nozzle group in Table 3, the control value '0' is mapped to the discrete quantities of ink corresponding to "−1" in FIG. 7. In case of the ninth nozzle group in Table 5, the control value '−2' is mapped to the discrete quantities of ink corresponding to "−1".

For the first red print region PU1_*r* of the first print region PU1, the first nozzle NZ1 to the fourth nozzle NZ4 are inputted by the control value mapped to the same discrete quantities of ink, and perform three discharge operations. The first nozzle NZ1 is inputted by the control value to discharge the discrete quantities of ink corresponding to "+1", the second nozzle NZ2 is inputted by the control value to discharge the discrete quantities of ink corresponding to "−1", and the third and fourth nozzles NZ3 and NZ4 are inputted by the control value to discharge the discrete quantities of ink corresponding to "0".

For example, the discrete quantities of ink corresponding to "+1" are 5.07 pl, and the discrete quantities of ink corresponding to "−1" are 4.93 pl. For the eighth nozzle group, the control value of '2' may be mapped to the discrete quantities of ink corresponding to "+1", while the control value of '0' may be mapped to the discrete quantities of ink corresponding to "−1" (see Table 3). For the eighth nozzle group, the control value of '0' may be mapped to the discrete quantities of ink corresponding to "+1", while the control value of '−2' may be mapped to the discrete quantities of ink corresponding to "−1" (see Table 5).

If the first nozzle NZ1 discharges the discrete quantities of ink corresponding to "+1" three times, the discrete quantities of ink corresponding to "+3" are discharged, so that the difference between the discrete quantities of ink and the wanted discrete quantities of ink for the first red print region PU1_*r* is increased. However, if the second nozzle NZ2 discharges the discrete quantities of ink corresponding to "−1" three times, and the third and fourth nozzles NZ3 and NZ4 discharge the discrete quantities of ink corresponding to "0" three times, the sum of the discrete quantities of ink to be discharged for the first red printing unit PU1_*r* becomes zero. This may be identical to the process in which the first to fourth nozzles NZ1 to NZ4 are inputted by the control value mapped to the wanted discrete quantities of ink corresponding to "0" and then perform the discharge operation. That is, the control value can be determined so that the sum of the discrete quantities of ink mapped to the control values in several discharge operations for the print region is equal to the wanted discrete quantities of ink which are ejected on the print region by discharging the set wanted discrete quantities of ink several times.

Similarly, for the second red print region PU2_*r* of the second print region PU2, the control values may be determined so that the first nozzle NZ1 discharges the discrete quantities of ink corresponding to "−1", the second nozzle NZ2 discharges the discrete quantities of ink corresponding to "0", the third nozzle NZ3 discharges the discrete quantities of ink corresponding to "+1", and the fourth nozzle NZ4 discharges the discrete quantities of ink corresponding to "0". Similarly, for the second red print region PU2_*r*, the discrete quantities of ink mapped to the control values which are determined to the respective nozzles may be different, but the average value of the discrete quantities of ink should be equal to that the discrete quantities of ink corresponding to "0" are printed on the second red print region PU2_*r*.

As the plurality of nozzles or one nozzle is inputted by the control values mapped to the different discrete quantities of ink in several discharge operations to perform the print, it is possible to alleviate orientation of the deviations caused by inputting the control value mapped to the discrete quantities of ink. For example, the second nozzle NZ2 discharges the ink of quantities less than the index reference value of the discharge performance, while the third nozzle NZ3 discharges the ink of quantities more than the index reference value of the discharge performance. In this instance, the average discrete quantities of ink can converge on the value corresponding to the ink of "0" through complementary action of two nozzles.

In other embodiment, one nozzle is inputted by different control values in several discharge operations to discharge different discrete quantities of ink, but the control value may be determined so that the sum of the discrete quantities of ink for one print region is equal to the 5.00 pl quantities of ink for target print, that is, the discrete quantities of ink corresponding to "0" discharged several times.

For the third red print region PU3_*r* of the third print region PU3, the control value may be determined so that the fifth nozzle NZ5 is inputted by a control value corresponding to discrete quantities of ink, "−1", "−1", "0", the sixth nozzle NZ6 is inputted by a control value corresponding to discrete quantities of ink, "−1", "1", "−1", the seventh nozzle NZ7 is inputted by a control value corresponding to discrete quantities of ink, "0", "1", "0", and the eighth nozzle NZ8 is inputted by a control value corresponding to discrete quantities of ink, "1", "0", "1". Each nozzle is inputted by the control value mapped to the different discrete quantities of ink through several discharge operations to discharge the ink, but the average discrete quantities of ink may maintain the wanted discrete quantities of ink corresponding to "0" for the third red print region PU3_*r*.

For the fourth red print region PU4_*r* of the fourth print region PU4, the control value may be determined so that the fifth nozzle NZ5 is inputted by a control value corresponding to discrete quantities of ink, "−1", "−1", "0", the sixth nozzle NZ6 is inputted by a control value corresponding to discrete quantities of ink, "0", "0", "0", the seventh nozzle NZ7 is inputted by a control value corresponding to discrete quantities of ink, "1", "0", "−1", and the eighth nozzle NZ8 is inputted by a control value corresponding to discrete quantities of ink, "0", "1", "0". Each nozzle is inputted by the control value mapped to the different discrete quantities of ink through several discharge operations to discharge the ink, but the average discrete quantities of ink may maintain the wanted discrete quantities of ink corresponding to "0".

Various control values inputted in such a way that the average of the discrete quantities of ink corresponds to the wanted discrete quantities of ink may be randomly determined under the condition in which the sum of the discrete quantities of ink is equal to the wanted discrete quantities of ink. As the nozzles are randomly inputted by the control values, it is possible to prevent the uniformity of the printed layer from being deteriorated due to the accumulated deviations between the discrete quantities of ink and the quantities of ink actually discharged from the respective nozzles. In particular, the adjustment of the discrete quantities of ink according to the random combination can be useful for the case where the nozzle discharges the discrete quantities of ink under the control according to the present disclosure.

Even in case where the nozzles are inputted by the control values mapped to the discrete quantities of ink, the quantities of the ink actually discharged from each nozzle according to the control value is not completely equal to the discrete quantities of ink. Tables 3 to 5 show the discrete quantities of ink and the control values mapped to the discrete quantities of ink, but each nozzle of the nozzle group can discharge the different quantities of ink within the range of the discrete quantities of ink.

Again, referring to FIG. 6, the sum of the quantities of the ink actually discharged from the nozzle according to the control value determined at step S341 is calculated, and then the sum is compared with the sum of the quantities of ink for the target print (step S342).

Referring to FIG. 7, 12 discharge operations are performed on the auxiliary pixel print regions PU1_*r*, PU1_*g*, PU1_*b*, . . . , PU4_*r*, PU4_*g*, PUU4_*b* forming the respective pixel print regions PU1, PU2, PU3, PU4, and the quantities of ink for the target print correspond to 12×5.00 pl=60.00 pl. The quantities of ink correspond to the results obtained by multiplying the discrete quantities of ink for the target discharge by the number of the discharge operations performed on the print region.

For the third red print region PU3_*r* of the third print region PU3, the control value corresponding to the discrete quantities of ink, "−1", "−1", "0", is determined for the fifth nozzle NZ5, the control value corresponding to the discrete quantities of ink, "−1", "1", "−1", is determined for the sixth nozzle NZ6, the control value corresponding to the discrete quantities of ink, "0", "1", "0", is determined for the seventh nozzle NZ7, and the control value corresponding to the discrete quantities of ink, "1", "0", "1", is determined for the eighth nozzle NZ8.

The quantities of the ink actually discharged from the fifth nozzle NZ5 to the eighth nozzle NZ8 can be calculated based on the discharge performance observed on the nozzle. Usually, the quantities of the ink discharged from the respective nozzles are within the range corresponding to the discrete quantities of ink, but the quantities of the ink actually discharged are deviated. If the deviations are added up, the quantities of the ink actually discharged are significantly deviated from the quantities of ink for the target print.

For example, referring to Tables 3 to 5, a gap in the discrete quantities of ink caused by the difference between the adjacent control values corresponds to 0.07 pl, and if the nozzle is inputted by the control value mapped to the discrete quantities of ink, the quantities of the ink actually discharged from the respective nozzles have a difference of 0.06 pl, as illustrated in Table 2 showing the dispersion of the quantities of the discharged ink in Table 2.

For the print region, the quantities of ink for the target print are compared with the sum of the quantities of the ink actually discharged by the determined control value, and the difference is calculated as a comparison value. If the comparison value is above a predetermined value (step S343), the control value determined for the nozzle is adjusted (step S344).

The predetermined value according to the embodiment corresponds to the gap in the discrete quantities of ink of which the control value inputted to the nozzle is changed, and the predetermined value corresponds to 0.07 pl in this embodiment of the present disclosure.

The control value may be adjusted by dividing the comparison value by the gap in the discrete quantities of ink according to the control value. For example, in case where the comparison value has a difference of 0.20 pl, the control value can be adjusted by 2. If the control value is adjusted as described above, any two values among the control values determined at step S341 can be adjusted by +1, or any one of the control values may be adjusted by +2.

In case where the control value is increased by 1, the quantities of the discharged ink can be expected by the gap in the discrete quantities of ink. Finally, as the quantities of the ink discharged for the print region is increased by the control value, for example, if the control value is adjusted by +2, the quantity can be compensated by 0.14 pl.

The quantities of the ink actually discharged from the nozzle can be inferred from the value measured when the discharge performance of the nozzle is determined, as explained in FIG. 3.

If the difference between the sum of the quantities of the ink actually discharged according to the determined control value and the quantities of ink for the target print is less than the predetermined value (NO at step S343), that is, if there is only difference which cannot be compensated by adjusting one control value, the print can be performed according to the control value determined without adjusting the control value for the nozzle.

The present disclosure can carry out various compensation processes of minimizing the deviations in quantities of the ink actually discharged within the range of the discrete quantities of ink by mapping the control value to the discrete quantities of ink.

In addition, the color filter of the display circuit has been explained in FIGS. 5 to 7 as an example, but the inkjet printing method according to the present disclosure is not limited to the printing of the display circuit or the color filter. The present disclosure can be applied to all processes of forming various layers by discharging the ink.

Figure 8:
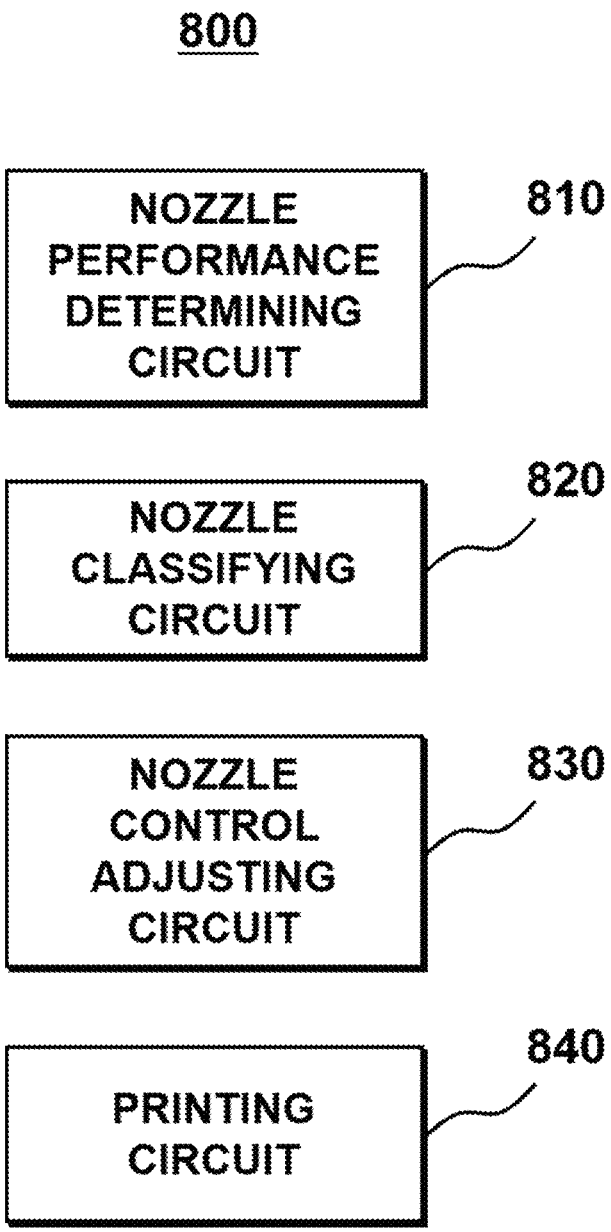
FIG. 8 is a block diagram illustrating an inkjet printing apparatus capable of carrying out the inkjet printing method according to one embodiment of the present disclosure.

FIG. 8 is a block diagram illustrating the inkjet printing apparatus capable of carrying out the inkjet printing method according to one embodiment of the present disclosure.

The inkjet printing apparatus according to the present disclosure includes a plurality of nozzles which are controlled to discharge the discrete quantities of ink mapped to a specific control value which is inputted by mapping the control value to the discrete quantities of ink. The plurality of nozzles is not illustrated in FIG. 8.

Referring to FIG. 8, an inkjet printing apparatus 800 includes a nozzle performance determining circuit 810, a nozzle classifying circuit 820, a nozzle control adjusting circuit 830, and a printing circuit 840.

The inkjet printing apparatus 800 can carry out the inkjet printing method described above, and can print a physical medium that can be read by a computer stored with a command of executing the inkjet printing method.

The nozzle performance determining circuit 810 can determine the discharge performance of a plurality of nozzles installed to the inkjet printing apparatus by inputting control values mapped to specific discrete quantities of ink for the nozzles. The nozzle performance determining circuit 810 receives data from the inside of the inkjet printing apparatus 800 or a device, such as a drop watcher, to determine the discharge performance of the nozzle. The discharge performance of the nozzles observed by the nozzle performance determining circuit 810 can be managed in the apparatus, and can be used for the process of compensating the control value pf the print region which performs several next discharge operations.

The nozzle classifying circuit 820 can classify the plurality of nozzles into plural nozzle groups based on the discharge performance determined for the plurality of nozzles.

The nozzle control adjusting circuit 830 can adjust the discrete quantities of ink and the control value mapped to the discrete quantities of ink for the classified nozzle groups. According to the embodiment, it is not always necessary to make the discrete quantities of ink and the control value mapped to the discrete quantities of ink different for the different nozzle groups. Although not illustrated, the inkjet printing apparatus 800 may include a storage space to manage identification information of the nozzles contained in the respective nozzle groups, the discrete quantities of ink and the control value mapped to the discrete quantities of ink.

The printing circuit 840 can perform the inkjet printing based on the discrete quantities of ink and the control value mapped to the discrete quantities of ink. As described with reference to FIGS. 5 to 7, the printing circuit 840 allows the quantities of ink for the target print according to the wanted discrete quantities of ink for the print region to be equal to the sum of the discrete quantities of ink mapped to the control value equal, and adjusts the control value for the nozzle through the process of comparing the quantities of the ink actually discharged from the respective nozzles and the quantities of the target print before printing.

The terminology used herein is for the purpose of describing particular embodiments only and is not intended to limit the right scope of the invention. Unless otherwise defined, all terms used herein have the same meaning as commonly understood by one of ordinary skill in the art to which this invention pertains, and should not be interpreted as having an excessively comprehensive meaning nor as having an excessively contracted meaning. If technical terms used herein fail to accurately express the technical idea of the present disclosure, they should be replaced with technical terms that allow the person in the art to properly understand. In addition, general terms used herein should be interpreted according to the definitions in the dictionary or in context, and should not be interpreted as having excessively contracted meanings. Furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. An inkjet printing method using a plurality of nozzles which are controlled to discharge discrete quantities of ink mapped to a specific control value, of which a control value and discrete quantities of ink are mapped, if the specific control value is inputted, the inkjet printing method comprising the steps of:

measuring discharge performance of the plurality of nozzles by inputting a control value mapped to specific discrete quantities of ink;

classifying the plurality of nozzles into a plurality of nozzle groups based on the discharge performance measured on the plurality of nozzles;

adjusting a mapped relation between the discrete quantities of ink and the control value for the classified nozzle groups; and performing inkjet printing based on the adjusted mapped relation between the discrete quantities of ink and the control value.

2. The inkjet printing method according to claim 1, wherein the step of classifying the plurality of nozzles into the plurality of nozzle groups includes a step of sorting the plurality of nozzle groups to correspond to the number of steps of the control value for controlling the plurality of nozzles.

3. The inkjet printing method according to claim 2, wherein the step of classifying the plurality of nozzles into the plurality of nozzle groups includes a step of classifying the plurality of nozzle into the plurality of nozzle groups based on measured quantities of ink actually discharged.

4. The inkjet printing method according to claim 3, wherein if the print region is printed through several discharge operations, the step of performing inkjet printing based on the mapping relation between the adjusted discrete quantities of ink and the control value includes a step of determining the control value so that quantities of ink for target print to be uniformly discharged for the print region are equal to a sum of the discrete quantities of ink mapped to the control value through several discharge operations.

5. The inkjet printing method according to claim 4, further comprising a step of, if a difference between the sum of the quantities of the ink actually discharged from the nozzle according to the determined control value and the quantities of the ink for the target print is equal to or more than a predetermined value, adjusting the determined control value.

6. The inkjet printing method according to claim 5, wherein the predetermined value corresponds to a gap in quantities of the ink discharged from the nozzle according to a difference between adjacent control values.

7. An inkjet printing apparatus having a plurality of nozzles which are controlled to discharge discrete quantities of ink mapped to a specific control value, of which a control value and discrete quantities of ink are mapped, if the specific control value is inputted, the inkjet printing apparatus comprising:

a nozzle performance measuring circuit for measuring discharge performance of the plurality of nozzles by inputting a control value mapped to specific discrete quantities of ink to the plurality of nozzles;

a nozzle classifying circuit for classifying the plurality of nozzles into a plurality of nozzle groups based on the discharge performance measured on the plurality of nozzles;

a nozzle control adjusting circuit for adjusting a mapped relation between the discrete quantities of ink and the control value for the classified nozzle groups; and a printing circuit for performing inkjet printing based on the adjusted mapping relation between the discrete quantities of ink and the control value.

8. The inkjet printing apparatus according to claim 7, wherein the nozzle classifying circuit sorts the plurality of nozzle groups to correspond to the number of steps of the control value for controlling the plurality of nozzles.

9. The inkjet printing apparatus according to claim 8, wherein the nozzle classifying circuit sorts the plurality of nozzle groups based on a distribution of the discharge performance measured on the plurality of nozzles.

10. The inkjet printing apparatus according to claim 9, wherein if the printing circuit prints the print region by discharging a plurality of droplets, the printing circuit selects a combination of discrete quantities of ink so that discrete quantities of ink to be uniformly discharged are equal to an average of discrete quantities of the droplets.

* * * * *